US006578209B2

(12) United States Patent
Lopes et al.

(10) Patent No.: US 6,578,209 B2
(45) Date of Patent: Jun. 17, 2003

(54) TUBS FOR BATHING INFANTS AND TODDLERS

(75) Inventors: A. Paula Lopes, Boston, MA (US); Michael A. Susi, Marlborough, MA (US); Christopher J. Reinke, West Townsend, MA (US); Ryan P. Rafter, Allston, MA (US)

(73) Assignee: The First Years Inc., Lake Forest, CA (US)

( * ) Notice: Subject to any disclaimer, the term of this patent is extended or adjusted under 35 U.S.C. 154(b) by 0 days.

(21) Appl. No.: 09/975,924

(22) Filed: Oct. 12, 2001

(65) Prior Publication Data

US 2003/0070219 A1 Apr. 17, 2003

(51) Int. Cl.[7] ..... A47K 3/024
(52) U.S. Cl. ..... 4/572.1
(58) Field of Search ..... 4/572.1

(56) References Cited

U.S. PATENT DOCUMENTS

| | | | | |
|---|---|---|---|---|
| 1,512,068 A | * | 10/1924 | Thornburg | 4/572.1 |
| D188,838 S | * | 9/1960 | Johnson | 4/572.1 |
| 4,561,135 A | * | 12/1985 | Adriaansen | 4/572.1 |
| RE32,806 E | * | 12/1988 | Gurolnick | 4/572.1 |
| 5,092,001 A | | 3/1992 | Ross et al. | 4/572.1 |
| 5,181,284 A | | 1/1993 | Raphael et al. | 4/572.1 |
| 5,276,926 A | | 1/1994 | Lopez | 4/572.1 |
| 5,361,430 A | | 11/1994 | Wise | 4/572.1 |
| 5,406,655 A | | 4/1995 | Sahlin | 4/572.1 |
| 5,588,159 A | | 12/1996 | Poulson et al. | 4/572.1 |
| 5,687,433 A | | 11/1997 | Garner et al. | 4/572.1 |
| 5,809,588 A | | 9/1998 | Angelotti | 4/572.1 |
| 5,966,752 A | | 10/1999 | Abugideiri | 4/572.1 |
| 6,112,343 A | | 9/2000 | Dixon | 4/572.1 |
| 6,158,065 A | | 12/2000 | Tuoriniemi et al. | 4/538 |

FOREIGN PATENT DOCUMENTS

| | | | | |
|---|---|---|---|---|
| GB | 2193887 | * | 2/1988 | 4/572.1 |

* cited by examiner

*Primary Examiner*—Robert M. Fetsuga
(74) *Attorney, Agent, or Firm*—Fish & Richardson P.C.

(57) ABSTRACT

A tub for bathing children is configured with opposing back rests and associated seating surfaces, for bathing an infant reclining against one of the back rests, or a toddler seated against the other back rest. The tub is molded of a shape enabling multiple tubs to nest particularly well, for efficient merchandising and storage, and includes a fresh water basin molded behind one of the back rests. The underside of the tub is configured to fit safely within either a standard kitchen sink, or one basin of a double sink.

31 Claims, 6 Drawing Sheets

TUBS FOR BATHING INFANTS AND TODDLERS

TECHNICAL FIELD

This invention relates to tubs for bathing infants and toddlers, particularly tubs configured to bathe children in both a reclined and a seated position.

BACKGROUND

Very young infants are unable to sit unsupported, and so are typically bathed in a reclined position. Inexpensive plastic tubs are sold for this purpose. These tubs are typically configured to be set upon a horizontal surface, such as a kitchen countertop, for use, and some of these tubs can fit in standard kitchen sinks.

As children develop the ability to sit up, they often are unwilling to remain reclined for bathing, but prefer to sit erect. Some parents then switch to bathing their children in an adult tub, although some would prefer to continue to bathe such children in smaller tubs, either for convenience and water conservation, or for fear of injury. At least one tub has been configured with a reclined back rest at one end for bathing infants, and a more upright back rest at the other end for bathing an older child in a seated position. Although such extended use tubs have been quite well received in the market, improvements are sought for the utility and efficiency of such tubs.

SUMMARY

We have realized several particularly useful improvements in the design and use of tub for bathing children. Our invention features a tub having a molded plastic body having an upper rim and defining a bathing basin sized for bathing a young child and having a bottom surface and opposing side walls forming opposite ends of the basin. A first of the opposing side walls extends at a first incline angle with respect to the rim, and a second, opposite one of the opposing side walls extends at a second incline angle with respect to the rim, the first and second inclined side walls forming back rests for children seated in the tub in different orientations. In this sense, the tub is useful for bathing at one time an infant reclined against the first back rest, and then, at another time, bathing a child seated erect against the second back rest.

Preferably, the bottom surface has two seating surface disposed at differing inclinations and extending from respective back rests to distal edges joined at a bottom surface apex spaced from either end of the basin, each seating surface forming, together with a respective one of the back rests, an inclined seat.

According to one aspect of the invention, the body has a nominal thickness an upper and lower surfaces having matching shape across an overall extent of the tub so as to enable tub to nest within an identical tub with a nesting space differential of less than about 2.0 inch (5 centimeters), preferably less than about 1.75 inch (4.5 centimeters). By "nesting space differential" we mean the maximum linear difference in space occupied by one tub and two tubs nested together. Generally, this will be the increase in vertical stack height caused by adding one more tub to a stack of already nested tubs. This parameter is critical to the efficient transportation and storage of tubs, particularly of molded plastic tubs that generally have little weight for the space they occupy. Occupied space can generally be considered the size of the smallest parallelepiped or box that will contain the tub.

According to another aspect of the invention, the body has a nominal thickness and upper and lower surfaces having matching shape across an overall extent of the tub so as to enable the tub to nest within an identical tub with a stacking factor of less than about 20 percent. By "stacking factor" we mean the increase in height of two such tubs nested together, as compared to a single such tub. For example, if each tub has a height of 10 inches (25 centimeters), and the tubs nested together have a stacked height of 12 inches (30 centimeters), then we would say that such tubs have a stacking factor of 20 percent.

In some embodiments, the cavity includes two side troughs extending along either side of the inclined seats and formed within wales defining resting points positioned to support the tub on a horizontal surface. Preferably, the wales form laterally aligned sink divider notches at one end of the cavity, and laterally aligned ledges at the other end of the cavity, with the notches sized and positioned to receive an upper edge of a divider of a double sink when the tub is placed over one basin of the double sink with the ledges resting on one outer edge of the sink. In some cases, the notch and ledge are separated along each wale by a distance of about 14.5 inches (37 centimeters).

In some embodiments, the wales each have longitudinal ends disposed behind the back rests and positioned to abut opposite walls of a single sink with the tub rim resting upon an upper edge of the sink and the tub disposed within the sink. Preferably, the longitudinal ends of each wale are spaced apart by a distance of about 20 inches (50 centimeters).

In some embodiments, the side troughs extend below and along either side of the bottom surface apex.

The tub rim defines a separate water basin behind one of the back rests in some constructions. The separate water basin may be defined between braces extending from behind one of the back rests, for example.

In some cases, the rim includes a downwardly depending, distal edge of the plastic body and forms guide ridges at one end of the tub for positioning edge clips of a tub cradle.

A drain hole may be provided in a bottom of the basin, with the tub including a removable drain plug for plugging the hole.

Preferably, the first inclined wall extends generally at an angle of between about 35 and 45 degrees with respect to horizontal with the tub resting upright on a horizontal surface. In a particularly preferred embodiment, the first inclined wall extends generally at an angle of about 41 degrees with respect to horizontal with the tub resting upright on a horizontal surface, with the seating surface associated with the first inclined wall inclined at about 45 degrees with respect to horizontal with the tub resting upright on a horizontal surface.

Preferably, the second inclined wall extends generally at an angle of between about 70 and 85 degrees with respect to horizontal with the tub resting upright on a horizontal surface. In the presently preferred embodiment, the second inclined wall extends generally at an angle of about 77 degrees with respect to horizontal with the tub resting upright on a horizontal surface, with the seating surface associated with the first inclined wall disposed generally horizontally with the tub resting upright on a horizontal surface.

The seating surfaces may be joined by a central bottom surface portion that rises from the distal edge of one of the seating surfaces to the distal edge of the other of the seating surfaces.

Preferably, the tub has an overall height of less than about 10 inches (25 centimeters).

The body may be molded of various resins, including polypropylene.

According to another aspect of the invention, the cavity of the tub includes two side troughs extending along either side of the inclined seats and formed within wales defining resting points positioned to support the tub on a horizontal surface, the wales forming laterally aligned sink divider notches at one end of the cavity, and laterally aligned ledges at the other end of the cavity, the notches sized and positioned to receive an upper edge of a divider of a double sink when the tub is placed over one basin of the double sink with the ledges resting on one outer edge of the sink.

In some embodiments, the body has a nominal thickness and upper and lower surfaces having matching shape across an overall extent of the tub so as to enable the tub to nest within an identical tub with a nesting space differential of less than about two inches (five centimeters).

The notch and ledge are preferably separated along each wale by a distance of about 14.5 inches (37 centimeters).

In some cases, the wales each have longitudinal ends disposed behind the back rests and positioned to abut opposite walls of a single sink with the tub rim resting upon an upper edge of the sink and the tub disposed within the sink. Preferably, the longitudinal ends of each wale are spaced apart by a distance of about 20 inches (50 centimeters).

In some embodiments the tub rim defines, behind one of the back rests, a separate water basin having a lower surface formed by a molded body surface positioned to rest upon the upper edge of the sink with the tub disposed within the sink. Preferably, the separate water basin is configured to hold at least about 20 ounces (0.6 liters) of water.

In some preferred embodiments, the body has a nominal thickness and upper and lower surfaces having matching shape across an overall extent of the tub so as to enable the tub to nest within an identical tub with a stacking factor of less than about 20 percent.

The above-described tubs enable yet another aspect of the invention, a method of bathing children. The method includes placing an infant in the tub of one of the above-described tubs, with the infant reclined against the first back rest; washing and removing the infant; placing a child in the tub, with the child seated against the second back rest; and washing the child.

Another aspect of the invention features a stack of tubs, each tub consisting of a tub configured as described above, the stack having an overall height less than 10 inches plus the quantity of two inches times the number of tubs, less one, in the stack.

In some cases, the stack consists of at least five tubs and has an overall height less than about 18 inches (46 centimeters).

The invention features improvements to the configuration of known "2-in-1" infant/toddler tubs, enabling more efficient packaging and greater utility.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
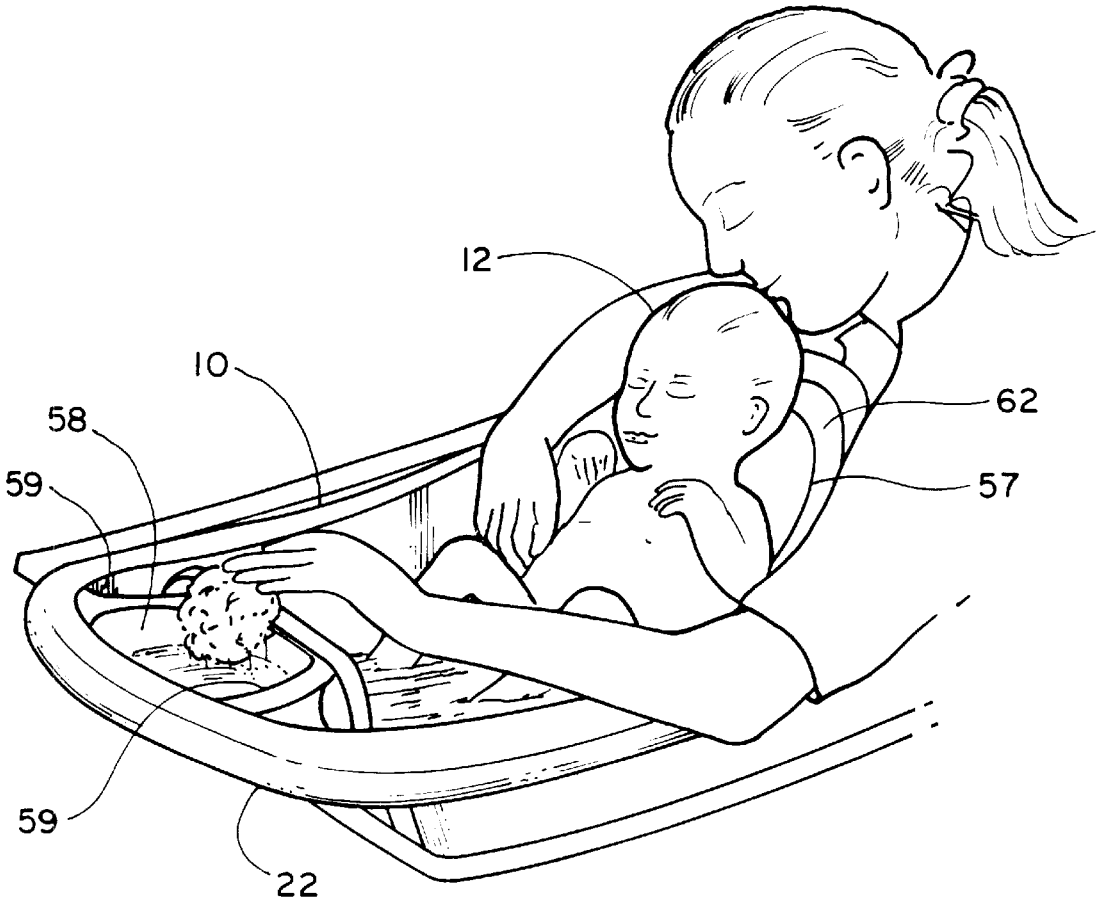
FIG. 1 shows an infant being bathed in a tub, in a reclined position.
Figure 2:
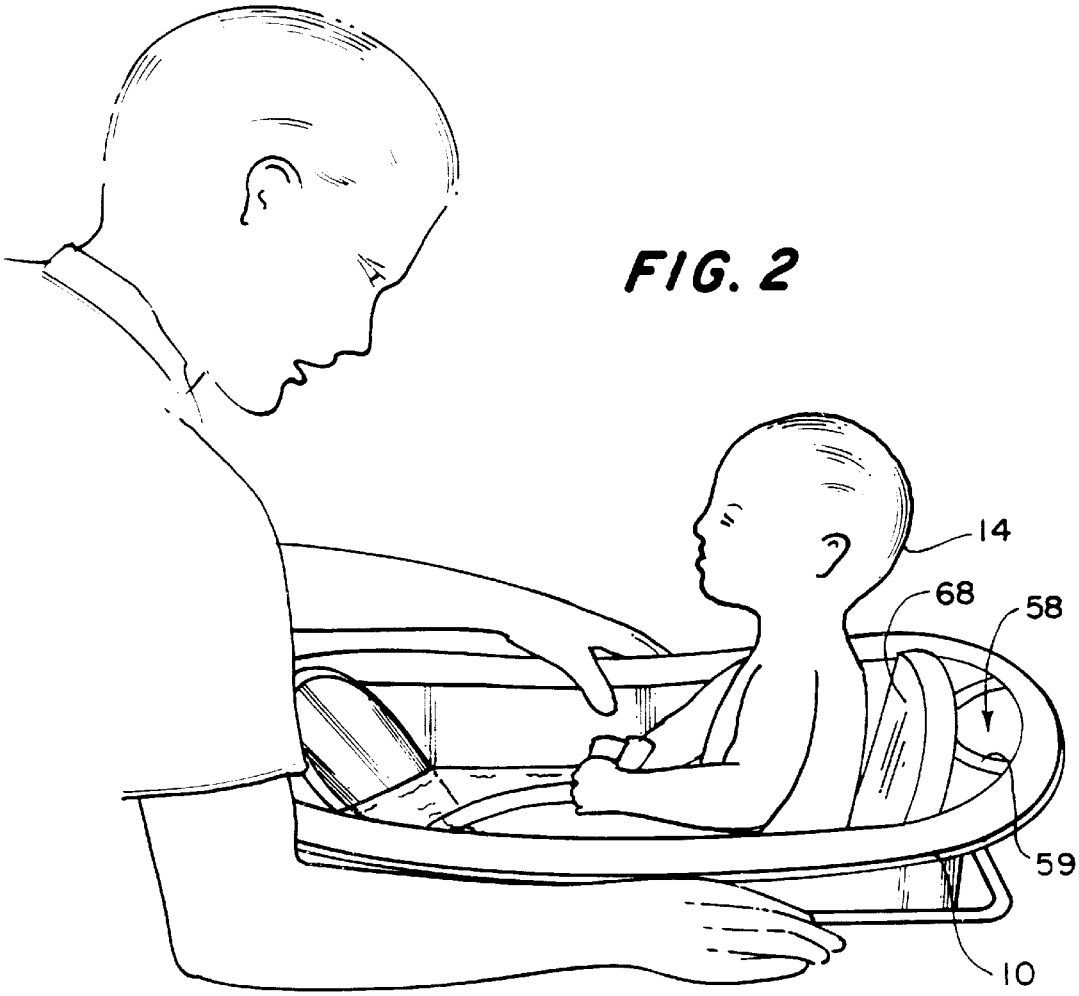
FIG. 2 shows a toddler being bathed in the tub of FIG. 1, but in a seated position.

Referring first to FIGS. 1 and 2, tub 10 is designed to be set into a sink for bathing either an infant 12 in a reclined position (FIG. 1), or a toddler 14 in an upright, seated position (FIG. 2). Tub 10 can also be stably set upon a horizontal surface outside of a sink.

Figure 3A:
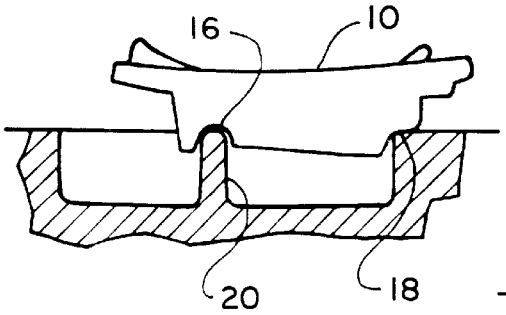
FIGS. 3A and 3B illustrate the tub installed over a double sink and a single sink, respectively.
Figure 3B:
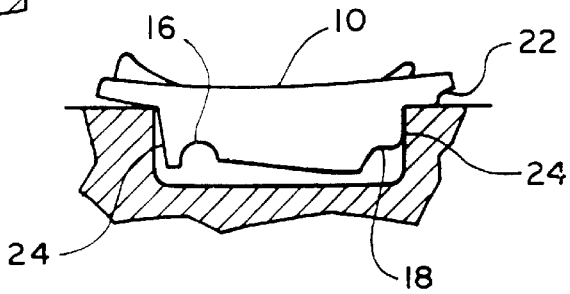

As shown in FIGS. 3A and 3B, tub 10 is configured to either be placed securely within a typical single kitchen sink (FIG. 3B), or over one basin of a typical double sink (FIG. 3A). To fit a standard double sink, or a smaller sink, a notch 16 is provided along the bottom of the tub and spaced apart from a ledge 18. Notch 16 receives the upper edge of the sink divider 20 when the tub is placed over the sink basin with ledge 18 resting on the sink edge. In place, the tub is prevented from moving forward or back by the contour of the underside of the tub, which extends down into the sink basin. For use in a standard single sink, or a larger sink basin, the tub is placed into the sink with the underside of its rim 22 (e.g., its fresh water basin) resting on the edge of the sink. Vertical side walls 24 of the tub are spaced apart so as to constrain the tub from moving back and forth when in place in a sink of typical dimensions.

Figure 4:
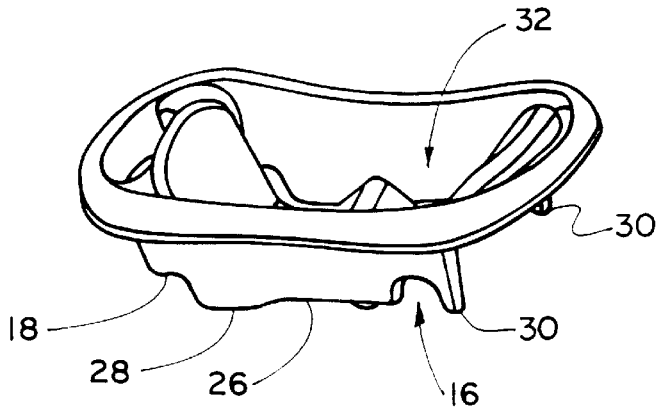
FIG. 4 is an upper perspective view of the tub.
Figure 5:
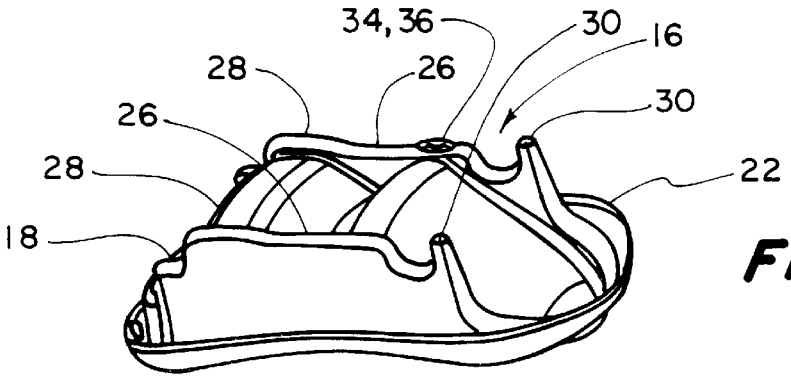
FIG. 5 is a lower perspective view of the tub.

Referring to FIGS. 4 and 5, the bottom of the tub includes two longitudinal, parallel wales 26 that define tub resting points in a plane corresponding to a flat horizontal surface upon which the tub may be set for use. These resting points include wale end portions 28 at one end of each wale, and projections 30 at the other end of each wale. For proper nesting with identical tubs, the inner surface of each wale 26 forms a trough 32 on the inside of the tub, running along either side of the seating surfaces, that receives a wale of a nested tub. A notch 16 is defined adjacent the projection 30 of each wale, for receiving a double sink divider as shown in FIG. 3A. A drain hole 34 is provided along one wale 26, in which an openable drain plug 36 is inserted.

Figure 6:
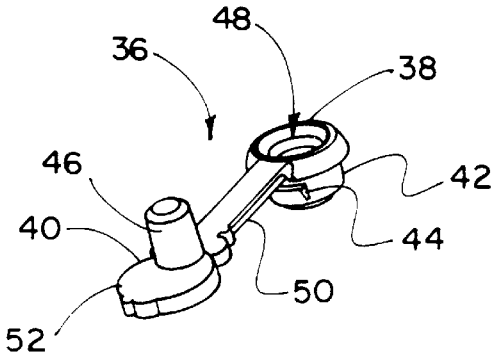
FIG. 6 is a perspective view of a drain plug.
Figure 7:
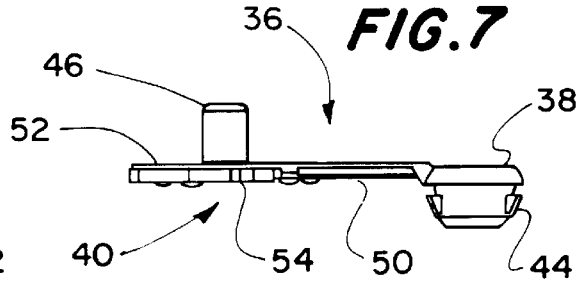
FIGS. 7 and 8 are side and bottom views, respectively, of the drain plug of FIG. 6.
Figure 8:
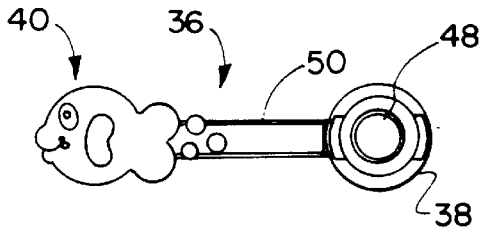

Details of drain plug 36 are shown in FIGS. 6 through 8. Plug 36 is a molded piece of flexible resin that has a receptacle end 38 and a plug end 40. The receptacle end has a projection 42 sized to fit within the tub drain hole, and has laterally extending ears 44 that engage a distal side of the tub to retain the plug in place. Once in place, a projection 46 of the plug end can be inserted in a drain opening 48 defined through receptacle end 38 by resiliently bending plug 36 at its central region 50. To open the drain, plug end 40 includes a graspable tab 52. As shown, an outer surface 54 of plug end 40 can be molded to include an aesthetically pleasing or entertaining graphic. The drain plug may also be molded of a material that changes color at elevated temperatures, or include some other temperature indicator.

Figure 9:
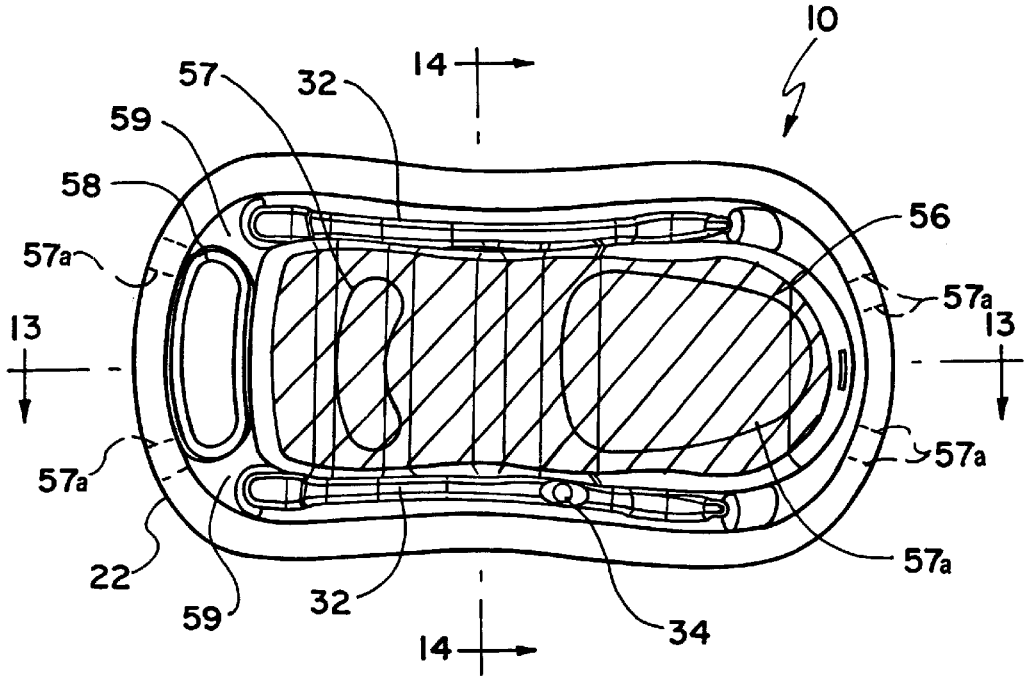
FIGS. 9 and 10 are top and side views, respectively, of the tub.

Referring next to FIG. 9, the seating and back rest surfaces of tub 10 are textured in an area 56 shown in cross-hatch, to help prevent sliding. Furthermore, padded foam layers 57 (shown in outline only) are applied after molding, such as with an adhesive, on the toddler seating surface and the infant back rest, for comfort. A separate water basin 58 is defined within rim 22 of the tub, behind one of the back rests and between two braces 59 extending from the back side of the back rest. Preferably, basin 58 is at least two inches across at its midpoint, to accommodate a child's drinking glass as used by many parents as a rinsing aid. In the presently preferred embodiment, basin 58 is configured to hold at least about 20 ounces (0.6 liters) or water. Alignment ribs 57 under the distal edge of rim 22 at either end of the tub define slots for receiving clips to secure an optional tub sling (not shown) across the tub basin.

Figure 10:
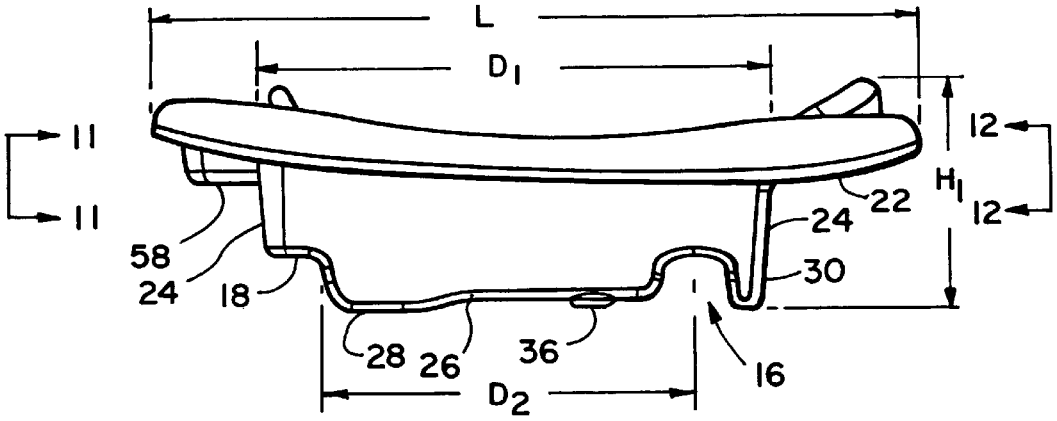
Figure 11:
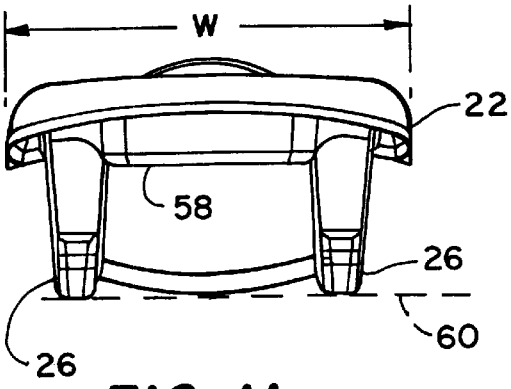
FIGS. 11 and 12 are end views of the tub, as seen in the direction of arrows 11—11 and 12—12, respectively, in FIG. 10.
Figure 12:
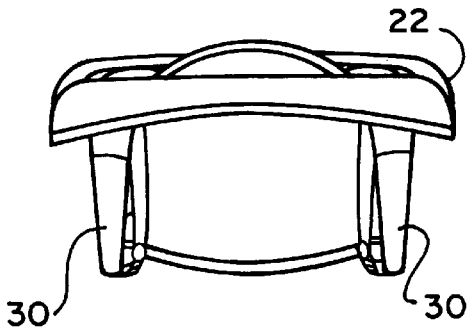

Referring to FIGS. 10 through 12, tub 10 has an overall length "L" of about 30 inches (76 centimeters), an overall height $H_1$ of about 9 inches (23 centimeters), and a width "W" of about 15.6 inches (40 centimeters). End wale surfaces 24, which are vertical save for a slight molding and nesting draft angle of about five degrees, are spaced apart a distance $D_1$ of about 20 inches (50 centimeters). This distance is selected to enable the tub to securely fit many common single sink basins. An inner edge of ledge 18 is spaced from the center of notch 16 a distance $D_2$ of about 14.5 inches (37 centimeters), so as to enable the tub to safely span one basin of many double sinks. Notches 16 have a width of about 2.8 inches (7.1 centimeters). FIG. 11 illustrates the rub resting on a flat, horizontal surface 60, such as a kitchen counter or table, and FIGS. 11 and 12 show that both seating surfaces are gently curved.

Figure 13:
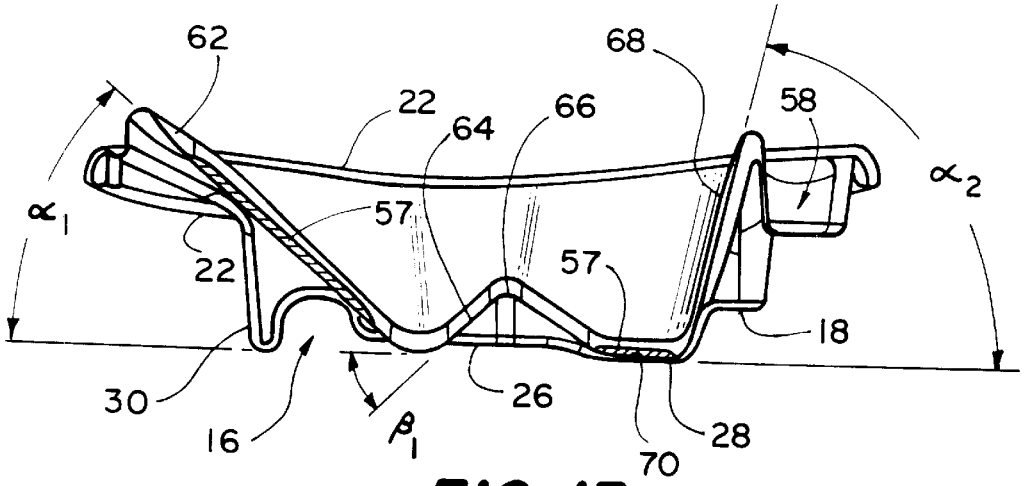
FIGS. 13 and 14 are cross-sectional views, taken along lines 13—13 and 14—14, respectively, in FIG. 9.

The general side profile of the seating surfaces can be seen in the cross-section of FIG. 13. As shown, two seating surfaces are disposed at one end of the tub (the left end, as shown), an inclined surface 62 extends generally at the angle $\acute{E}_1$ of about 41 degrees and serves as a back rest for a reclining infant (see also FIG. 1). At the lower end of surface 62, a tub bottom surface 64 extends upward generally at an angle $\acute{e}_1$ of about 45 degrees and forms a seating surface associated with back rest 62, with apex 66 received behind the knees of the infant. At the other end of the tub (the right end, as shown), an opposing back rest 68 extends generally at the angle $\acute{E}_2$ of about 77.5 degrees and serve as a back rest for a toddle seated on generally horizontal seating surface 70 (see also FIG. 2).

Figure 14:
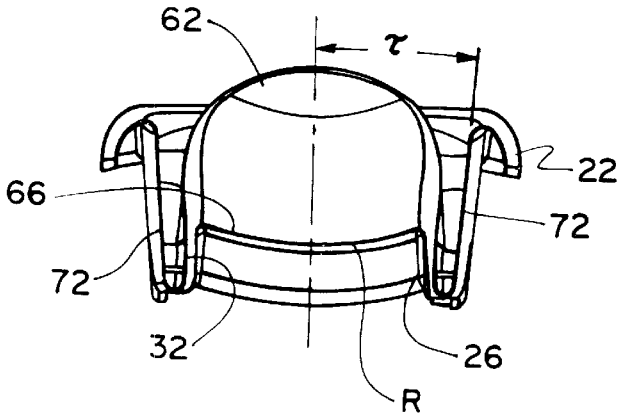

As seen in FIG. 14, the side walls 72 of the tub, as well as most other surfaces that extend generally perpendicular to the horizontal resting plane of the rub, are molded at a draft angle $\tau$, with respect to vertical, of about five degrees. We find that this draft angle provides sufficient draft to keep multiple nested tubs from undesirably sticking together. Low ribs may also be molded onto broad tub surfaces to help avoid vacuum lock between nested tubs, without significantly increasing the stacking factor. Also shown is that the curvature of apex 66 generally follows a radius "R" of about 12 inches (30 centimeters), similar to the curvature of the infant seating surface.

That the upper and lower surfaces of the tub are complementary enables the tub to efficiently nest. The polypropylene body of the tub 10 is molded as one-piece with a nominal wall thickness, as defined between the complementary upper and lower surfaces, of only about 0.085 inch (2.2 millimeters).

Figure 15:
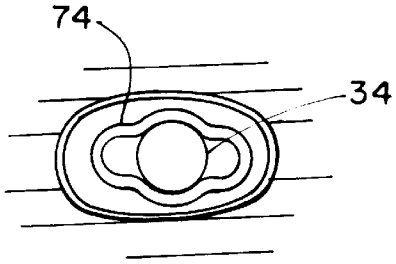
FIG. 15 is an enlarged view of the drain hole of the tub, as viewed from under the tub.

FIG. 15 shows a flat recess 74 molded about drain hole 34 and configured to provide relief for the drain plug in its closed condition.

Figure 16:
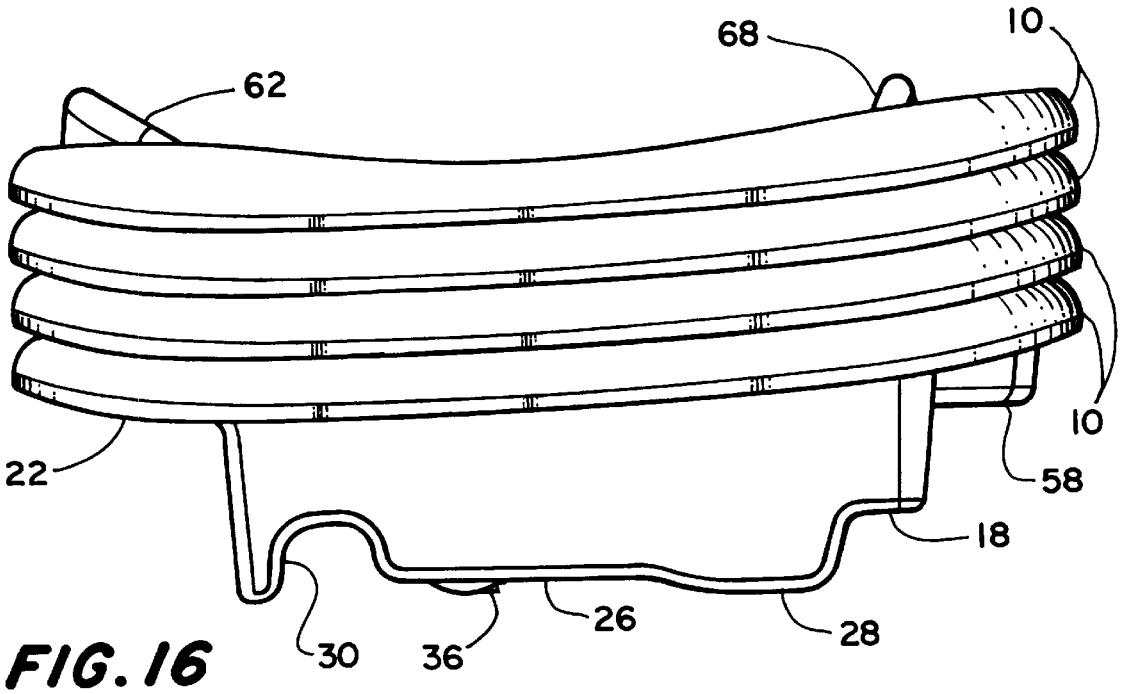
FIGS. 16 and 17 are side and end views, respectively, of a stack of four of the tubs.
Figure 17:
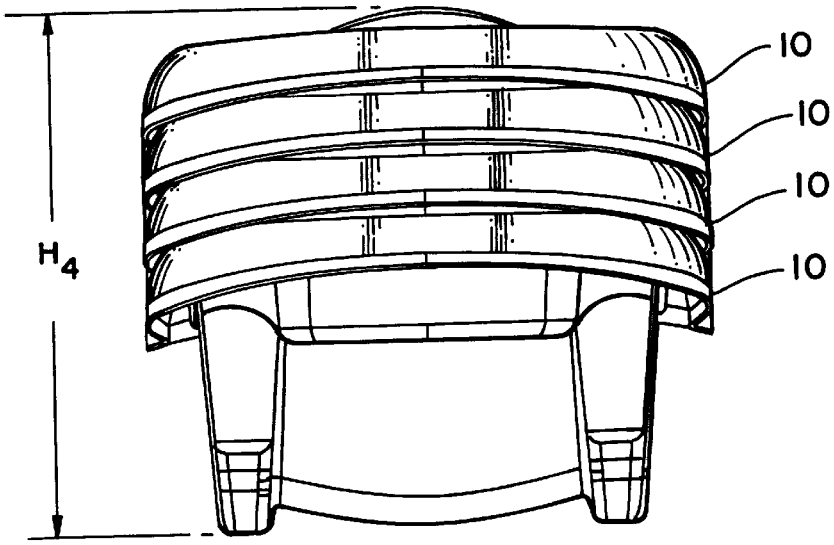

Tubs 10 can nest together with a very low stacking factor, to great advantage in reducing space required for merchandising and shipping. In some preferred embodiments, tubs 10 nest with a stacking factor of less than about 20 percent. For example, FIGS. 16 and 17 show four such tubs stacked together to have an overall stacked height $H_4$ of only about 14.1 inches (36 centimeters). This is because each additional tub adds only about 1.7 inches (4.3 centimeters) of height to the stack. Preferably, at least five tubs will be stackable within an overall height of 18 inches (46 centimeters), for efficient merchandising. The illustrated embodiment enables stacking of six tubs within this height.

A presently preferred embodiment of the invention has been described. Nevertheless, it will be understood that various modifications may be made without departing from the spirit and scope of the invention. Accordingly, other embodiments are within the scope of the following claims.

What is claimed is:

1. A tub for bathing children, the tub comprising a molded plastic body having an upper rim and defining a bathing basin sized for bathing a young child and having a bottom surface and opposing side walls forming opposite ends of the basin, a first of the opposing side walls extending at a first incline angle with respect to the rim, and a second, opposite one of the opposing side walls extending at a second incline angle with respect to the rim, the first and second inclined side walls forming first and second back rests for children seated in the tub in different orientations;

the bottom surface having two seating surfaces disposed at differing inclinations and extending from respective back rests to distal edges joined at a bottom surface apex spaced from either end of the basin, each seating surface forming, together with a respective one of the back rests, an inclined seat;

wherein the body has a nominal thickness and upper and lower surfaces having matching shape across an overall extent of the tub so as to enable the tub to nest within an identical tub with a nesting space differential of less than about two inches (five centimeters).

2. The tub of claim 1 wherein the cavity includes two side troughs extending along either side of the inclined seats and formed within wales defining resting points positioned to support the tub on a horizontal surface.

3. The tub of claim 2 wherein the wales form laterally aligned sink divider notches at one end of the cavity, and laterally aligned ledges at the other end of the cavity, the notches sized and positioned to receive an upper edge of a divider of a double sink when the tub is placed over one basin of the double sink with the ledges resting on one outer edge of the sink.

4. The tub of claim 3 wherein, along each wale, the notch and ledge are separated by a distance of about 14.5 inches (37 centimeters).

5. The tub of claim 2 wherein the wales each have longitudinal ends disposed behind the back rests and positioned to abut opposite walls of a single sink with the tub rim resting upon an upper edge of the sink and the tub disposed within the sink.

6. The tub of claim 5 wherein the longitudinal ends of each wale are spaced apart by a distance of about 20 inches (50 centimeters).

7. The tub of claim 2 wherein the side troughs extend below and along either side of the bottom surface apex.

8. The tub of claim 1 wherein the tub rim defines, behind one of the back rests, a separate water basin.

9. The tub of claim 8 wherein the separate water basin is defined between braces extending from behind one of the back rests.

10. The tub of claim 1 wherein the rim includes a downwardly depending, distal edge of the plastic body and forms guide ridges at one end of the tub for positioning edge clips of a tub cradle.

11. The tub of claim 1 defining a drain hole in a bottom of the basin, and further comprising a removable drain plug.

12. The tub of claim 1 wherein the first inclined wall extends generally at an angle of between about 35 and 45 degrees with respect to horizontal with the tub resting upright on a horizontal surface.

13. The tub of claim 12 wherein the first inclined wall extends generally at an angle of about 41 degrees with respect to horizontal with the tub resting upright on a horizontal surface.

14. The tub of claim 12 wherein the seating surface associated with the first inclined wall is inclined at about 45 degrees with respect to horizontal with the tub resting upright on a horizontal surface.

15. The tub of claim 1 wherein the second inclined wall extends generally at an angle of between about 70 and 85 degrees with respect to horizontal with the tub resting upright on a horizontal surface.

16. The tub of claim 15 wherein the second inclined wall extends generally at an angle of about 77 degrees with respect to horizontal with the tub resting upright on a horizontal surface.

17. The tub of claim 15 wherein the seating surface associated with the first inclined wall is disposed generally horizontally with the tub resting upright on a horizontal surface.

18. The tub of claim 1 wherein the seating surfaces are joined by a central bottom surface portion that rises from the distal edge of one of the seating surfaces to the distal edge of the other of the seating surfaces.

19. The tub of claim 1 having an overall height of less than about 10 inches (25 centimeters).

20. The tub of claim 1 wherein the body is molded of a resin comprising polypropylene.

21. The tub of claim 1 nestable within an identical tub with a nesting space differential of less than about 1.75 inches (4.5 centimeters).

22. A method of bathing children, comprising placing an infant in the tub of claim 1, with the infant reclined against the first back rest;

washing the infant;

removing the infant;

placing a child in the tub, with the child seated against the second back rest; and washing the child.

23. A tub for bathing children, the tub comprising a molded plastic body having an upper rim and defining a bathing basin sized for bathing a young child and having a bottom surface and opposing side walls forming opposite ends of the basin, wherein the body has a nominal thickness and upper and lower surfaces having matching shape across an overall extent of the tub so as to enable the tub to nest within an identical tub with a stacking factor of less than about 20 percent;

a first of the opposing side walls extending at a first incline angle with respect to the rim, and a second, opposite one of the opposing side walls extending at a second incline angle with respect to the rim, the first and second inclined side walls forming first and second back rests for children seated in the tub in different orientations;

the bottom surface having two seating surfaces disposed at differing inclinations and extending from respective back rests to distal edges joined at a bottom surface apex spaced from either end of the basin, each seating surface forming, together with a respective one of the back rests, an inclined seat;

wherein the cavity includes two side troughs extending along either side of the inclined seats and formed within wales defining resting points positioned to support the tub on a horizontal surface, the wales forming laterally aligned sink divider notches at one end of the cavity, and laterally aligned ledges at the other end of the cavity, the notches sized and positioned to receive an upper edge of a divider of a double sink when the tub is placed over one basin of the double sink with the ledges resting on one outer edge of the sink.

24. The tub of claim 23 wherein the body has a nominal thickness and upper and lowers surface having matching shape across an overall extent of the tub so as to enable the tub to nest within an identical tub with a nesting space differential of less than about two inches (five centimeters).

25. The tub of claim 24 wherein, along each wale, the notch and ledge are separated by a distance of about 14.5 inches (37 centimeters).

26. The tub of claim 23 wherein the wales each have longitudinal ends disposed behind the back rests and positioned to abut opposite walls of a single sink with the tub rim resting upon an upper edge of the sink and the tub disposed within the sink.

27. The tub of claim 26 wherein the longitudinal ends of each wale are spaced apart by a distance of about 20 inches (50 centimeters).

28. The tub of claim 26 wherein the tub rim defines, behind one of the back rests, a separate water basin having a lower surface formed by a molded body surface positioned to rest upon the upper edge of the sink with the tub disposed within the sink.

29. The tub of claim 28 wherein the separate water basin is configured to hold at least about 20 ounces (0.6 liters) of water.

30. A tub for bathing children, the tub comprising a molded plastic body having an upper rim and defining a bathing basin sized for bathing a young child and having a bottom surface and opposing side walls forming opposite ends of the basin, wherein the body has a nominal thickness and upper and lower surfaces having matching shape across an overall extent of the tub so as to enable the tub to nest within an identical tub with a nesting space differential of less than about two inches (five centimeters);

a first of the opposing side walls extending at a first incline angle with respect to the rim, and a second, opposite one of the opposing side walls extending at a second incline angle with respect to the rim, the first and second inclined side walls forming first and second back rests for children seated in the tub in different orientations;

the bottom surface having two seating surfaces disposed at differing inclinations and extending from respective back rests to distal edges joined at a bottom surface apex spaced from either end of the basin, each seating surface forming, together with a respective one of the back rests, an inclined seat;

wherein the cavity includes two side troughs extending along either side of the inclined seats and formed within wales defining resting points positioned to support the tub on a horizontal surface, the wales forming laterally aligned sink divider notches at one end of the cavity, and laterally aligned ledges at the other end of the cavity, the notches sized and positioned to receive an upper edge of a divider of a double sink when the tub is placed over one basin of the double sink with the ledges resting on one outer edge of the sink.

31. The tub of claim 30 wherein, along each wale, the notch and ledge are separated by a distance of about 14.5 inches (37 centimeters).

* * * * *